US010945523B2

(12) United States Patent
Albrecht et al.

(10) Patent No.: US 10,945,523 B2
(45) Date of Patent: Mar. 16, 2021

(54) DEVICE FOR CONNECTING A PUSH ELEMENT TO A GUIDE RAIL, GUIDANCE SYSTEM AND PIECE OF FURNITURE OR HOUSEHOLD APPLIANCE

(71) Applicant: Grass GmbH, Hoechst (AT)

(72) Inventors: Markus Albrecht, Lustenau (AT); Gabriel Auer, Maeder (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 16/209,175

(22) Filed: Dec. 4, 2018

(65) Prior Publication Data

US 2019/0166996 A1 Jun. 6, 2019

(30) Foreign Application Priority Data

Dec. 4, 2017 (DE) ..... 10 2017 128 749

(51) Int. Cl.
*A47B 88/42* (2017.01)
*A47B 88/427* (2017.01)

(52) U.S. Cl.
CPC .... *A47B 88/427* (2017.01); *A47B 2088/4274* (2017.01); *A47B 2088/4276* (2017.01); *A47B 2210/0016* (2013.01)

(58) Field of Classification Search
CPC . A47B 88/407; A47B 88/0407; A47B 88/423; A47B 88/0418; A47B 88/427; A47B 88/0422; A47B 2088/4272; A47B 2088/0425; A47B 2088/4274; A47B 2088/0429; A47B 2088/4276;
(Continued)

(56) References Cited

U.S. PATENT DOCUMENTS 5,580,139 A 12/1996 Grabher
5,632,541 A * 5/1997 Uthoff ..... A47B 88/427 312/333

(Continued)

FOREIGN PATENT DOCUMENTS

DE 203 05 467 U1 9/2004
DE 11 2011 101 781 T5 5/2013

(Continued)

OTHER PUBLICATIONS

European Search Report (Application No. 18209758.4) dated Jan. 23, 2019—8 pages.

(Continued)

*Primary Examiner* — Andrew M Roersma
(74) *Attorney, Agent, or Firm* — Burr & Brown, PLLC

(57) ABSTRACT

A device for connecting a movable push element of a piece of furniture or a household appliance to a guide rail. According to the present invention, the device comprises a locking arm with a locking member, wherein in the mounted condition of the device the locking member is designed to be coupled with a locking element, wherein the elongated locking arm is connected by two spaced-apart elastic attachment members to the remainder of the device, which attachment members engage with the locking arm transversely to a longitudinal extension of the locking arm, so that the locking arm is movable in the region of the locking member in a direction transverse to the longitudinal extension of the locking arm and in the direction of the attachment members.

12 Claims, 6 Drawing Sheets

(58) Field of Classification Search
CPC .... A47B 2088/0433; A47B 2088/4278; A47B 2088/0437; A47B 2210/09; A47B 2210/091; A47B 2210/0016
See application file for complete search history.

(56) References Cited

U.S. PATENT DOCUMENTS

| | | | | |
|---|---|---|---|---|
| 7,549,712 | B2 * | 6/2009 | Booker | F16F 9/0218 312/333 |
| 8,528,998 | B2 | 9/2013 | Leal | |
| 8,696,078 | B2 * | 4/2014 | Gasser | A47B 88/427 312/348.2 |
| 8,979,223 | B2 * | 3/2015 | Huang | A47B 88/427 312/334.4 |
| 10,314,396 | B2 * | 6/2019 | Hsu | A47B 88/407 |
| 2004/0239219 | A1 | 12/2004 | Kim et al. | |
| 2013/0257244 | A1 * | 10/2013 | Salice | A47B 88/423 312/319.1 |
| 2014/0175965 | A1 | 6/2014 | Salice | |
| 2016/0198855 | A1 * | 7/2016 | Liang | A47B 88/427 248/241 |
| 2016/0242543 | A1 * | 8/2016 | Mohr | F16C 29/004 |
| 2017/0095082 | A1 * | 4/2017 | Lucas | A47B 88/427 |
| 2019/0239643 | A1 * | 8/2019 | Lucas | A47B 88/407 |

FOREIGN PATENT DOCUMENTS

| | | | | |
|---|---|---|---|---|
| DE | 10 2013 114 722 | A1 | 11/2014 | |
| EP | 0 695 523 | A1 | 2/1996 | |
| WO | WO-2010040273 | A1 * | 4/2010 | A47B 88/427 |

OTHER PUBLICATIONS

German Search Report (Application No. 10 2017 128 749.3) dated Oct. 15, 2018.

* cited by examiner

DEVICE FOR CONNECTING A PUSH ELEMENT TO A GUIDE RAIL, GUIDANCE SYSTEM AND PIECE OF FURNITURE OR HOUSEHOLD APPLIANCE

This application claims the benefit under 35 USC § 119(a)-(d) of German Application No. 10 2017 128 749.3 filed Dec. 4, 2017, the entirety of which is incorporated herein by reference.

FIELD OF THE INVENTION

The present invention relates to a device for connecting a push element to a guide rail, a guidance system, and a piece of furniture or household appliance.

BACKGROUND OF THE INVENTION

Systems or connecting devices for the connecting of a push element of a piece of furniture or a household appliance to a guide rail of a guidance system of a piece of furniture or household appliance are known.

The connecting devices are used, for example, for guidance systems as so-called partial extensions with two guide rails or full extension with three guide rails, in regard to a pull-out structural unit, wherein the rails can be moved telescopically to each other.

Generally, a push element such as a drawer, a shelf, a cooking product carrier or the like is movably received by precisely two separate but identical components of a partial extension or a full extension. The respective structural unit of the extension guides is preferably secured to an inner side of a furniture body or a housing of a household or kitchen appliance.

Since the attachment of a push element of a piece of furniture or a household appliance to a guide rail must stand up to high demands in terms of functionality, user friendliness, and economy, modifications are needed in this regard.

SUMMARY OF THE INVENTION

The problem which the present invention proposes to solve is to provide a connecting device for a movable push element, a guidance system and a piece of furniture or a household appliance which is improved in regard to a technically advantageous connecting of the push element to a guide.

The present invention starts from a device for connecting a movable push element of a piece of furniture or a household appliance, such as a kitchen appliance, to a guide rail of a guidance system of the piece of furniture or the household appliance, wherein the device is designed to be mounted on the movable push element. Preferably, the connecting device is designed so that it is fastened, in particular, with a tool, on the push element. In the condition of the connecting device mounted on the push element, the push element can be manually connected to the guide rail in the correct position, firmly yet detachably, and dismounted once again.

The crux of the present invention is that the device comprises a locking arm with a locking member, wherein in the mounted condition of the device the locking member is designed to be coupled with a locking element, especially with a locking element of the guide rail, wherein the locking arm is provided as an elongated element, wherein the locking arm is connected by two spaced-apart attachment members to the remainder of the device, especially by precisely two attachment members, wherein the attachment members engage with the locking arm transversely, especially perpendicularly, to a longitudinal extension of the locking arm, wherein the attachment members are elastic, so that the locking arm is movable, for example, displaceable, in the region of the locking member in a direction transverse to the longitudinal extension of the locking arm and in the direction of the attachment members.

In the mounted condition of the device according to the present invention, a longitudinal axis of the elongated element of the locking arm extends advantageously at least approximately parallel to a direction of movement of the push element and/or a direction of movement of the guide rail. The guide rail, e.g., is a push element rail or a movement rail of the furniture guidance system.

Preferably the locking arm is joined as a single piece via the attachment members to the remaining portion of the connecting device. Accordingly, the locking arm, the attachment members and the remaining portion of the connecting device are preferably fashioned as a single piece, which is advantageous in terms of manufacturing technology and economy.

The movability of the locking arm relative to the remaining portion of the connecting device transversely to its longitudinal extension is determined substantially by a first or linear motion component. A subordinate second motion component can be a swiveling or rotary motion component, which is superimposed onto the first linear motion component. The attachment members realize a mounting of the kind of a jointly moving swivel bearing site of a locking arm swiveling about a swivel axis. With the attachment members, an articulation is provided between the locking arm and the remaining portion of the connecting device. The two attachment members constitute a kind of four-link arrangement for the movement mounting of the locking arm. Preferably, at least two separate pivot points on the locking arm and on the remaining portion of the connecting device are formed with the attachment members. With the single-piece design of the locking arm on the remaining portion of the connecting device via the attachment members, an elastic movement or a spring-loaded movement is possible, which is nevertheless characterized substantially as a linear movement or a pushing movement. Advantageously, with the relatively easily formed attachment members, there is no need for an additional or separate component on the remaining device, such as a linear acting spring element, which accomplishes the elastic movement of the locking member, or a comparatively complex linkage arrangement.

On the other hand, despite the single-piece attachment members, essentially no swivel movement is produced, but instead a pushing movement of the locking member, which is advantageous in terms of a secure connection in different connection positions, looking in the sideways direction of the push element. This is because the connection between locking member and locking element must allow for an equalizing of tolerances, which usually occurs in practice. The secure connection or coupling of push element and guide rail is always achieved by the correct latching of locking member and locking element, even when a slight deviation from an ideal position of the push element and/or the guide rail occurs in the direction transversely to the longitudinal extension of the locking arm or sideways, which may be due in practice to installation tolerances, for example.

Advantageously, therefore, precisely one locking member on the locking arm may be enough to establish a secure coupling or interlocking with the locking element, which is preferably multiple-toothed looking in the longitudinal direction of the locking arm, in every possible relative position of push element and guide rail.

In the known arrangements it is a disadvantage, among other things, that a plurality of locking members or a complex contour of the locking member is necessary in order to interact with a locking contour, e.g., on the guide rail side, which necessarily provides a plurality of different locking positions. Furthermore, the quality of locking or retention of the achievable interlocking in such arrangements decreases noticeably under deviations from an ideal relative position of push element and guide rail in the sideways direction. This is because, in the known arrangements, an orientation of the locking member relative to the locking element firmly present on the guide rail is changed during a swivel movement of a locking arm with a locking member with increasingly larger swivel deflections of the locking arm. The result is an increasingly worse engagement or interlocking of the segments being coupled together. The coupling quality in the prior art diminishes with increasing swivel deflection of the locking member. This drawback is eliminated by the present invention.

The attachment members, for example, comprise a first attachment member, which is connected to the locking arm at a first site, looking in the lengthwise direction of the locking arm. A second attachment member is connected to the locking arm at a second site, looking in the lengthwise direction of the locking arm, the second site being further away from the locking member than the first site in the lengthwise direction. The first site and the second site are separated from one another by a few millimeters, for example, such as around 5 millimeters. The overall length of the locking arm amounts to around 6 to 8 centimeters, for example. The two attachment members engage with the locking arm over its entire length, looking in the region adjacent to the midlength of the locking arm.

It is furthermore advantageous that the locking arm comprises a control element, which is angled relative to the remaining elongated element of the locking arm so that the locking arm is movable by means of the control element. The control element forms a lever arm with respect to the locking arm with a torque action, so that the locking arm can be moved relative to the remaining connecting device about a bearing point of the locking arm formed with the attachment members. Preferably, the locking arm has a front part-length segment, on which the locking member is formed. The locking member is preferably present at a free end of the locking arm or the front part-length segment. The front part-length segment is preferably substantially straight in configuration. The locking arm furthermore has a rear part-length segment, which is preferably likewise straight in configuration and angled relative to the front part-length segment, and this comprises the control element. Both part-length segments have preferably roughly the same length. The two attachment members are preferably connected to the front part-length segment with the locking arm, especially in proximity to the segment in which the front and the rear part-length segments meet. This segment forms, for example, an angling of the locking arm between the two part-length segments.

Basically, in addition to the two attachment members, at least one further attachment member may be present or engaging with the locking arm.

The control element enables an easier manual decoupling of the locking arm or the locking member from the locking element. The control element accordingly serves for decoupling the locking member, in order to then move the push element away from the guidance system.

On the other hand, during the installing of the push element, the coupling movement of the locking arm occurs, in particular, by a self-acting deflection movement of the locking arm when the push element is mounted on the respective guide rail, without having to act on the control element. Since the locking member is pressed against a segment of the locking element when the push element is mounted on the guide rail, and is thereby somewhat elastically deflected and moved past the locking element into a final installed position of the push element on the guide rail until a coupling or locking is established. The interlocking of locking member and mating segment on the locking element occurs with the return movement of the locking arm on account of the previously elastically deformed attachment members, since these produce temporarily a pretensioning of the locking arm due to the deflecting. A force exerted from the outside is needed for the deflection movement of the locking arm from a base or neutral position and for the movement of the locking member past the segment of the locking element into the preliminary latching and final locking position. This is done by an installer bringing up the push element with the connecting device arranged thereon as a whole in correct orientation to the piece of furniture, placing it thereon and moving it into the final position. Generally, two guide rails of a respective right and left structural unit of the guidance system are present on the piece of furniture or on the household appliance or their opposite side walls. For the installing, the respective guide rails on the piece of furniture or household appliance are pushed out so that it is possible to place the push element on the guide rails.

The angled arrangement of the control element on the locking arm is mechanically advantageous on account of a leverage action on the locking arm, as well as easy handling.

A further benefit is characterized in that during a positioning of the locking arm the locking arm performs both a movement transversely to its longitudinal extension and/or along its longitudinal extension, especially parallel to its longitudinal extension, wherein during a positioning a movement path transversely to its longitudinal extension is comparatively larger than a movement path lengthwise to its longitudinal extension. In the deflecting movement under consideration of the locking arm during the installation process, the ratio of the movement path in the transverse direction to a movement path in the lengthwise direction is a maximum in the optimal case or the movement path in the lengthwise direction is zero millimeters, for example. The movement path in the transverse direction is, for example, 2 to 5 millimeters. In the minimal lengthwise movement, no movement occurs for the locking arm and especially for the locking member in the lengthwise direction. This means that ideally a pure transverse movement will occur, e.g., a transverse pushing movement of the segment or the region of the locking arm with the locking member relative to the longitudinal extension of the locking arm, or the lengthwise movement will be minimal.

A positioning or moving of the locking arm is done, for example, by a user grasping the connecting device, for example, acting on the control element, for example, during a decoupling, or during an installing of the push element on the guide rail.

It is also advantageous that the locking member is present, in particular, as a single locking tooth. In this way, a reliable and stable latching is accomplished with a simple shape of the locking member. Just one locking tooth can be provided in a more stable and simple configuration than many smaller locking teeth.

One advantageous modification of the present invention is provided in that the attachment members are designed substantially as cuboidal wall elements. The cuboidal shape pertains, in particular, to a contour looking from above at respective surface sides of the attachment members. Each of the two attachment members has a comparatively slight thickness as compared to the length of the attachment member, e.g., a first attachment member has a thickness of around 0.5 to 1 millimeter and a second attachment member e.g. around 2 millimeters. A spacing between the two attachment members in the longitudinal direction on the locking arm is, e.g., around 4 to 6 millimeters. A pivot of the first attachment member on the remaining locking arm has a lesser distance from the locking member, looking in the lengthwise direction of the locking arm, than a pivot of the second attachment member on the remaining locking arm. The attachment members are accordingly preferably offset in the longitudinal extension of the locking arm. A coinciding articulation of the two attachment members on at least one side of the two attachment members, such as on the locking arm or on the opposite portion of the base component, is likewise conceivable.

The attachment member is configured, for example, as a strip or, for example, a platelet or a blade. The attachment members have a straight or preferably in each case a curved shape, being curved, for example, in the opposite direction from each other. An attachment member is configured, for example, as a thin, wall-like web segment.

The first attachment member has one side with a concave curve directed toward the locking member in the lengthwise direction of the locking arm, and accordingly an opposite convex curved side facing away from the locking member.

The second attachment member has one side with a convex curve directed toward the locking member in the lengthwise direction of the locking arm, and accordingly an opposite concave curved side facing away from the locking member.

It is also advantageous that a thickness of an attachment member decreases in the direction of the locking arm. The thickness decrease preferably occurs gradually or continuously over the length of the attachment member.

The locking arm and the attachment members preferably belong to a base component of the connecting device, which is designed as a single piece. The connecting device preferably furthermore comprises an adjusting component, with a control element and a height adjusting element, which can be releasably attached to and swiveled on the base component.

One attachment member is preferably oriented at a slant or transversely to the lengthwise direction of the locking arm in the extension of the attachment member. One end of an attachment member is connected on the locking arm and an opposite end of the attachment member is connected on the remaining portion of the base component.

Between the two ends of the attachment members facing away from the locking arm, there is preferably arranged a wall segment of the base component of the connecting device that joins these ends. The connecting wall segment of the base component is configured such that, upon elastic deformation of the attachment members, when the locking arm is moved or pushed, the wall segment behaves at least almost mechanically rigid or is not significantly elastically deformed. This realizes a firm mounting of the two attachment members at their respective end facing away from the locking arm. The attachment members are accordingly elastic, such that when the locking arm is moved or pushed the attachment members are elastically deformed between their ends engaging with the locking arm and engaging with the remaining base component. The deformation occurs when the push element is mounted on the guide rail and when the push element is lifted by manual effort, for example, of an installer or user.

Both the ends of the two attachment members engaging with the remaining base component and the ends of the attachment members engaging with the locking arm are connected to the remaining base component and the locking arm over their entire height, i.e., transversely to the longitudinal extension of the locking arm and transversely to the movement or pushing direction of the locking arm. The attachment members preferably have the same height throughout their length.

Another advantageous embodiment of the present invention results in that a thickness of one attachment member is larger than a thickness of the other attachment member. By the thickness of an attachment member is meant a material thickness or the thickness over the major extension or an averaged or mean thickness of the attachment member.

The first attachment member preferably has a lesser mean thickness than the second attachment member or vice versa.

Preferably the first attachment member has a relatively slight thickness at its end connected to the locking arm of e.g. 0.5 to 1 millimeter and a thickness of around 2 millimeters at its other end.

Preferably the second attachment member has a thickness at its end connected to the locking arm of e.g. around 2 millimeters and a thickness of around 2.5 to 3 millimeters at its other end.

In particular, with the respective thickness and/or the shape of the attachment members it is possible to adapt the elastic behavior of the two attachment members differently from each other and relative to each other so that precisely the desired movement mounting of the locking arm is possible. When a force acts from the outside on the locking arm, resulting in a movement of the locking arm relative to the remaining portion of the base component, the attachment member with the lesser thickness is elastically deformed in a different way, such as more strongly or at an earlier time, than the thicker attachment member. Besides the thickness of the attachment members, the respective shape of the attachment members, especially a curved shape, influences the elastic behavior of the attachment members or the movement of the locking arm.

It is furthermore advantageous that the device comprises a locking element which is present as a single structural part separate from the remaining device, wherein the locking element comprises a mounting element, the mounting element being designed to mount the locking element on an end face of a guide rail, wherein the locking element is designed to interlock with the locking member of the device in the mounted condition of the device.

Preferably the connecting device comprises on the one hand the main piece with the base component and the adjusting component, which are plugged together for example, for mounting on the push element, especially in the region of a push element bottom side, and on the other hand the locking element, which can be premounted on the guide rail. The locking element which can be preferably attached onto the end face of the guide rail, such as an element made of a plastic material, furthermore forms in the mounted condition on the guide rail an engaging section in the area of the guide rail end face, which engaging section engages with engaging means on the base component in the properly interacting connection condition of the main piece and the locking element. The engaging section and the engaging means are adapted so that, upon reaching the interlocked condition and in the locked condition of locking member and locking element, a play is made possible between the engaging means and end stops of the engaging segment in a height direction and/or in a side direction of the connecting device running transversely to it.

Thus, a sideways play and/or a play in the height direction of the push element mounted with the device on the guide rail is possible.

Furthermore, a device for connecting a movable push element of a piece of furniture or a household appliance, such as a kitchen appliance, to a guide rail of a guidance system of the piece of furniture or the household appliance is proposed. According to the present invention, the device comprises spring means, wherein the spring means are present such that, in the mounted condition of the device on the push element, the coupling of the locking member to the locking element is pretensioned in a direction along the longitudinal extension of the locking arm. The spring means are formed preferably on the locking element as two elastically deflectable spring webs, for example.

Advantageously, the spring means make possible an equalizing of tolerances, especially an equalizing of the spacing between a front end of the push element and an end face of the guide rail. In practice, for example, slight deviations from an ideal installation condition of the push element on the guide rail may occur, due to the manufacturing process, so that different spacings of the respective segments may occur in the low millimeter range. Such deviations can be equalized by the spring means, so that a connection free of play, or an installation without clamping, is possible with no undesirable vibration in the condition or use.

Furthermore, a guidance system for guiding the movement of a push element of a piece of furniture or a household appliance, such as a kitchen appliance, is proposed, with a guide rail, which can be associated with the push element, wherein a device according to one of the aforementioned embodiments is present.

The present invention further extends to a piece of furniture or household appliance with a guidance system of the aforementioned kind. In this way, the mentioned benefits can be realized on the piece of furniture or household appliance.

BRIEF DESCRIPTION OF THE DRAWINGS

Further features and benefits of the present invention are explained more closely with the aid of the exemplary embodiments of the present invention as represented in the figures. Specifically, there are shown.

DETAILED DESCRIPTION OF THE INVENTION

In part, the same reference numbers are used below for corresponding elements of different exemplary embodiments.

Figure 1:
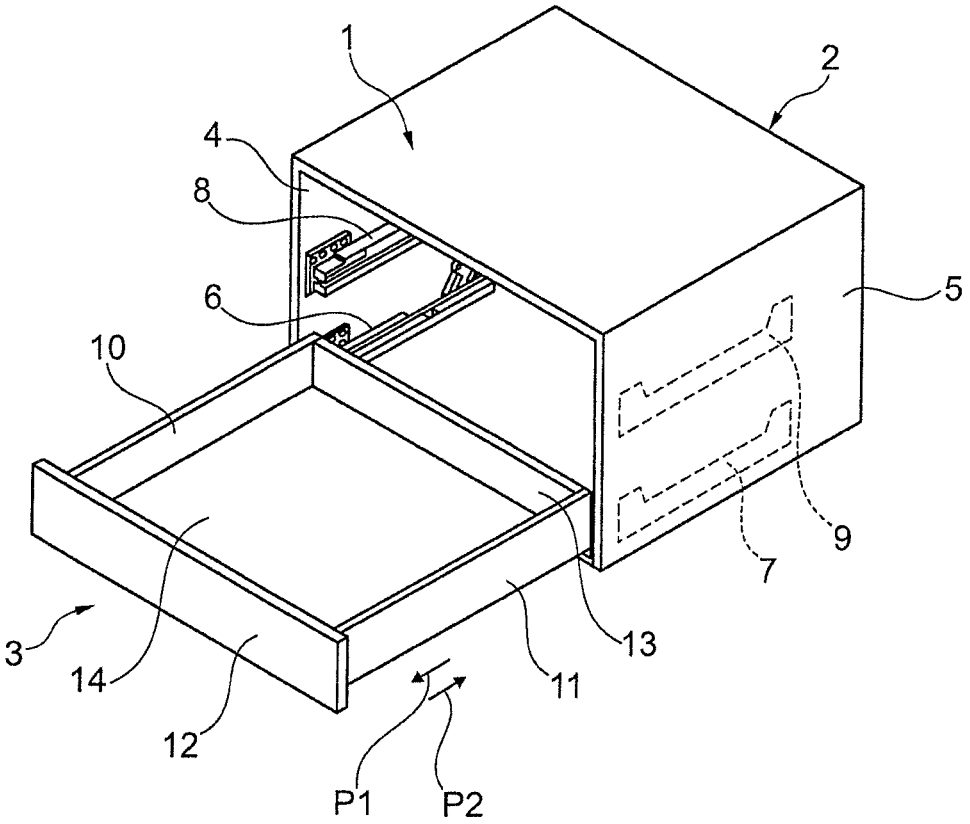
FIG. 1 shows a schematically represented piece of furniture according to the present invention in perspective view, slanting from above, with a drawer received movably therein.

FIG. 1 shows highly schematized a piece of furniture 1 according to the present invention in a condition of use with a hollow cuboidal furniture body 2 and a push element fashioned as a drawer 3, wherein the drawer 3 is received displaceably on the furniture body 2. The furniture body 2 comprises two opposite vertical side walls 4 and 5, between which the drawer 3 can be pulled out in the horizontal direction from the furniture body 2 per P1 from a condition accommodated in the interior of the furniture body 2 via a guidance system according to the present invention with telescoping guiding means or a first rail full extension 6 and a second rail full extension 7 and pushed into the body in the opposite direction per P2. In FIG. 1, the drawer 3 is shown in the condition moved out to the utmost or entirely from the interior of the furniture body 2. Hence, the storage volume of the drawer 3 is accessible from above with almost no hindrance.

If the drawer 3 uses a rail partial extension instead of the rail full extensions 6, 7, the drawer 3 in the maximum pulled-out condition cannot be moved so far out from the interior of the furniture body 2 in the direction P1, as is possible with the rail full extensions 6, 7 per the representation in FIG. 1. The front element 12 is then closer to the open front side of the furniture body 2 than is shown in the drawer 3 of FIG. 1.

The rail full extension 6 screwed to the side wall 4 on the inside is located at the same vertical height as the rail full extension 7 screwed to the side wall 5 and hidden from view in FIG. 1, being indicated by broken lines.

A further drawer correspondingly guided by rail full extensions 8 and 9 can be accommodated in the furniture body 2 above the drawer 3, not being shown in FIG. 1.

The drawer 3 comprises oppositely situated drawer side walls 10, 11, each comprising a constructed hollow chamber frame. Furthermore, the drawer 3 comprises a front element 12, a rear wall 13 situated opposite in the horizontal direction, and a horizontally extending drawer bottom 14, which reaches as far as the drawer side walls 10, 11, the front element 12 and the rear wall 13 or is joined to them.

Figure 2:
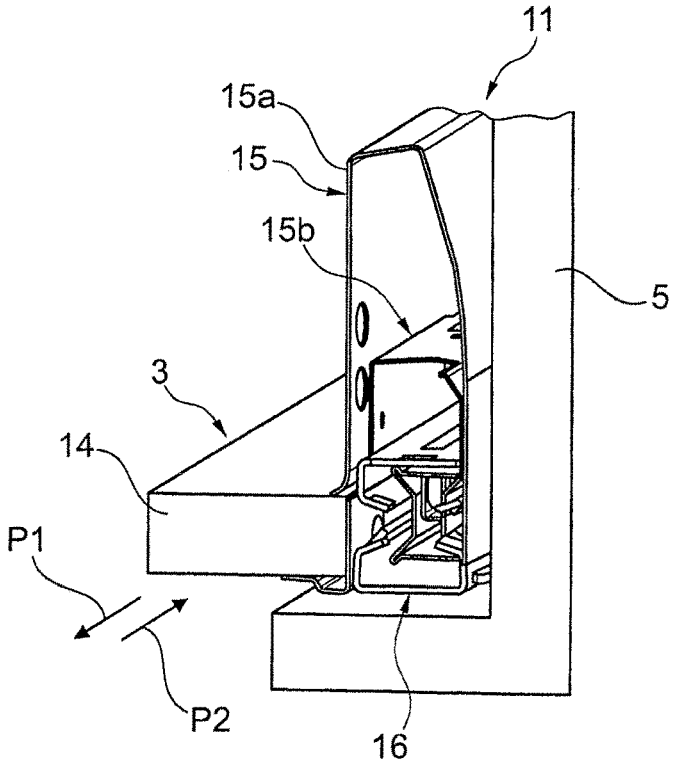
FIG. 2 shows in cross section, a perspective cutout view of a piece of furniture in the region of a drawer side, adjacent to a furniture body wall and a furniture body bottom.
Figure 3:
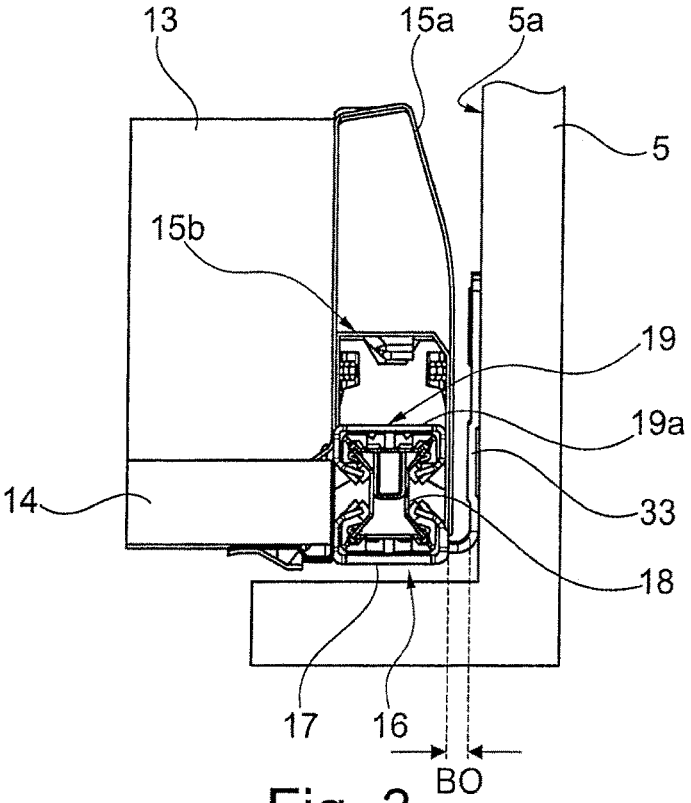
FIG. 3 shows the cutout of FIG. 2 in a front view.

FIGS. 2 and 3 show no subfloor push element connection with a connecting device according to the present invention in the region of a body side wall 5, but rather a hollow chamber frame connection in the cutout of a drawer 3 with a drawer bottom 14 and a drawer side wall 11 and a rear wall 13 designed as a hollow chamber frame 15. The drawer 3 is received by two structural units of a guidance system according to the present invention on the furniture body 2 or by a rail full extension 16 according to the present invention on the side wall 5 and in the same manner by a further hollow chamber frame of the drawer 3 on the side wall 4 not visible in FIG. 2. The drawer is received on the side wall 4 by a further structural unit or a further full extension according to the present invention, by which the drawer 3 can move in a linear horizontal manner in the directions P1 and P2.

The hollow chamber frame 15 made preferably from a bent sheet metal material has an external housing 15*a* and an internal structure 15*b*, so that the full extension 16 can be recessed into the internal volume of the hollow chamber frame 15. At an inner side of the hollow chamber frame 15, it is configured to receive a lengthwise edge of the drawer bottom 14 in its lower segment.

The full extension 16 according to the present invention formed as a structural unit of the guidance system comprises three mutually telescopic guide rails or a body rail 17, a center rail 18 and a push element rail 19.

The center rail 18 is configured as a hollow profile.

A push element to be moved such as the drawer 3 is coupled or connected to the push element rail 19, for example, it is secured to the hollow chamber frame 15, whereas the body rail is connected to the stationary part of the furniture. If the full extension 16 is being used as a subfloor guide, a bottom side of a push element or its bottom will be braced against a top side 19*a* of the push element rail 19. A hook element 19*b* protruding upward at the rear end of the push element rail 19 forms an end stop for a segment of a rear outer side of the push element, wherein for the exact positioning an angled segment of the hook element 19*b* parallel to the top side 19*a* engages with a suitably provided recess in the rear outer side of the push element. In this way, the rear region of the full extension 16 in the condition of use is also established in FIG. 4, on the left side in FIG. 4, and a front region of the full extension 16 in the condition of use is established on the right side in FIG. 4. A horizontal linear pushing direction 30 of the rails 18 and 19 to the front or to the rear in the condition of use of the full extension 16 is indicated by a double arrow in FIG. 4.

Furthermore, the full extension 16 comprises a first or lower carriage 20 with bearing bodies arranged thereon, the carriage 20 acting between the body rail 17 and the center rail 18 for a load-transmitting relative movement of the rails 17, 18.

Moreover, the full extension 16 comprises a second or upper carriage 21 with bearing bodies arranged thereon, the carriage 21 acting between the center rail 18 and the push element rail 19 for a load-transmitting relative movement of the rails 18, 19.

Pins 32 are present on a vertically positioned, inwardly pointing narrow side of a rail body 31 of the body rail 17, by which pins a movement mechanism 22 of the full extension 16 can be attached, for example, for the ejecting and/or retracting of the drawer 3.

The body rail 17 includes two L-shaped fastening elements 33 and 34, the fastening elements 33 and 34 serving for the fastening or securing of the full extension 16 to an inner side of the side wall of a body, such as the inner side 5*a* of the side wall 5 of the furniture body 2 of the piece of furniture 1.

In the exemplary embodiment of FIG. 3, the fastening elements 33 and 34 have a horizontal leg greatly curtailed in width, having a width BO. Hence, a spacing between the outer side of the hollow chamber frame 15 and an inner side 5*a* of the side wall 5 can be minimized, which maximizes the receiving volume of the drawer 3.

The guide rails 17, 18, 19 preferably consist of a sheet metal material, which is formed into the end product of the respective guide rail from the flat sheet metal material, for example, by a stamping and bending process.

In order to limit a relative movement of the lower carriage 20 and the upper carriage 21 with respect to the center rail 18 in the longitudinal extension of the center rail 18 along a central longitudinal axis S (see FIG. 4), upper end stops 35 and lower end stops 36 are provided on the center rail 18.

In the assembled full extension 16, the bearing bodies received on the carriages 20, 21 run on the outwardly directed sides of the center rail 18 or on the horizontal wall sections 23, 24 and the side wall sections 25-28. The lower carriage 20 engages by its segments 20*a* and 20*b* carrying the bearing bodies on the outside of the horizontal wall section 24 and the side wall sections 27, 28.

The upper carriage 21 engages by its segments 21*a* and 21*b* carrying the bearing bodies on the outside of the horizontal wall section 23 and the side wall sections 25, 26.

Accordingly, the respective corresponding bearing bodies of the lower carriage 20 roll along the distal side of the lower horizontal wall section 24, on the outer side of the side wall section 27 and on the outer side of the side wall section 28.

The respective corresponding bearing bodies of the upper carriage 21 roll along the distal side or the outer side of the upper horizontal wall section 23, on the outer side of the side wall section 25 and on the outer side of the side wall section 26.

The bearing bodies of the carriages 20, 21 are preferably outwardly cylindrical bearing bodies or roller bearing bodies such as bearing rollers or bearing needles.

The center rail 18 formed from an originally flat and level metal sheet is formed as a hollow profile and has a bonded connection or a welded connection or narrow weld seam 29 over its length along the longitudinal axis S. The weld seam 29 produced preferably with a continuous laser method joins on one side of the center rail 18 narrow, blunt abutting edges of a lower part region and an upper part region of the center rail 18.

The hollow profile form of the center rail 18 enables a mechanically highly stable center rail 18, especially one that is bending and torsion stiff. The center rail 18 is furthermore compact and space-saving and material-saving in terms of its configuration.

Figure 4:
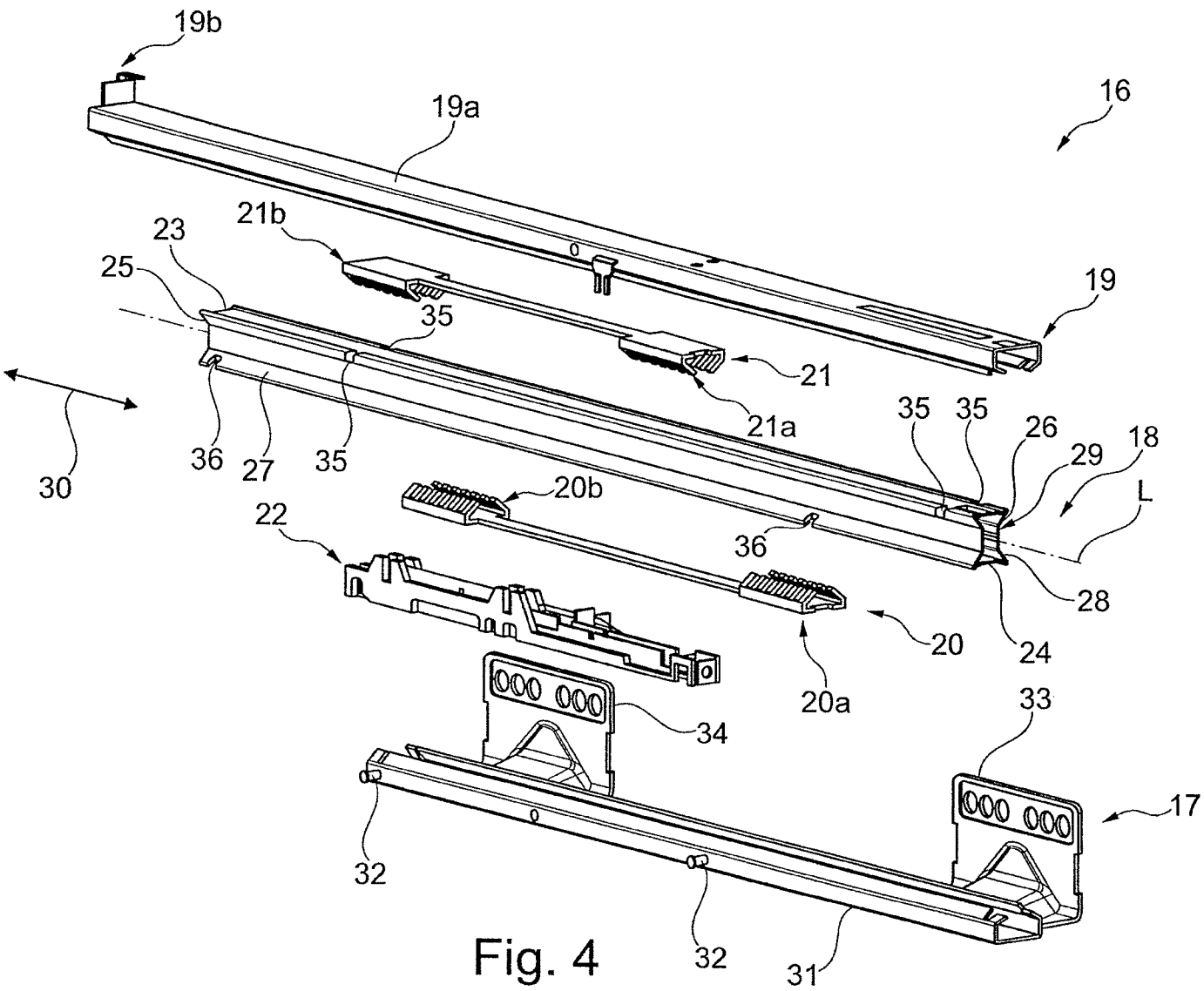
FIG. 4 shows an exploded view of a structural unit of a guidance system without a connecting device according to the present invention.
Figure 5:
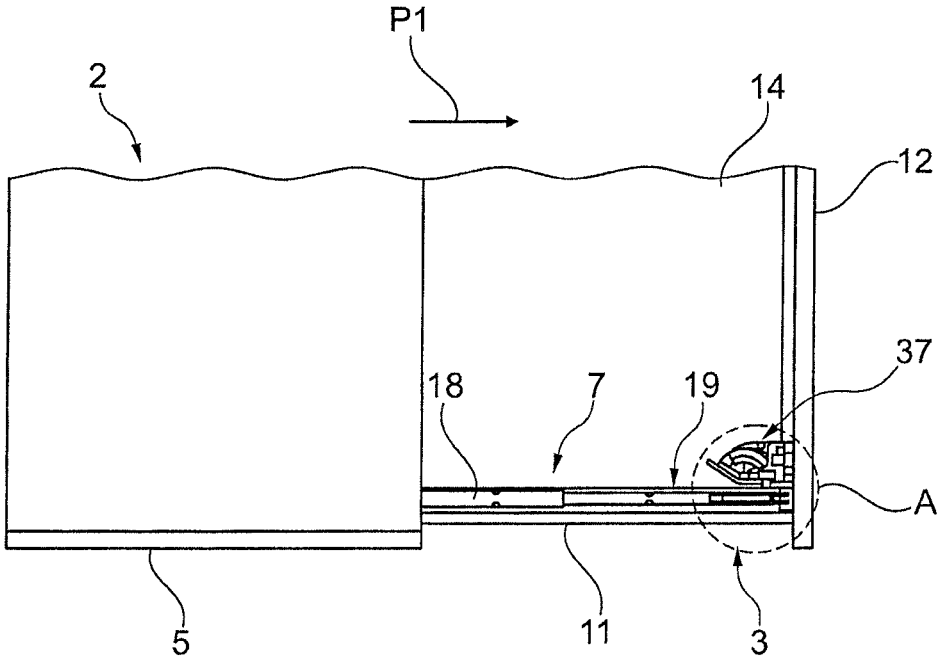
FIG. 5 shows a cutout view of a bottom view of the piece of furniture of FIG. 1 with a structural unit of a guidance system, which is fastened to the piece of furniture with the connecting device according to the present invention.

FIG. 5 shows the piece of furniture 1 of FIG. 1 without a left part region seen from the front, in a bottom view with the drawer 3 pulled out in the direction P1. The rail full extension 7, which is designed as a full extension 16 per FIG. 4, is acted upon by a connecting device 37 according to the present invention, for example. The connecting device 37 serves for a push element height adjustment and for the interlocking of the drawer 3 on the respective push element rail 19 of the rail full extensions 6 and 7, which are screwed onto the furniture body 2.

Accordingly, a corresponding connecting device 37 according to the present invention acts on the rail full extension 6 needed for the movement of the drawer 3 and not shown in FIG. 5, which is likewise outfitted in accordance with the full extension 16 of FIG. 4.

Figure 6:
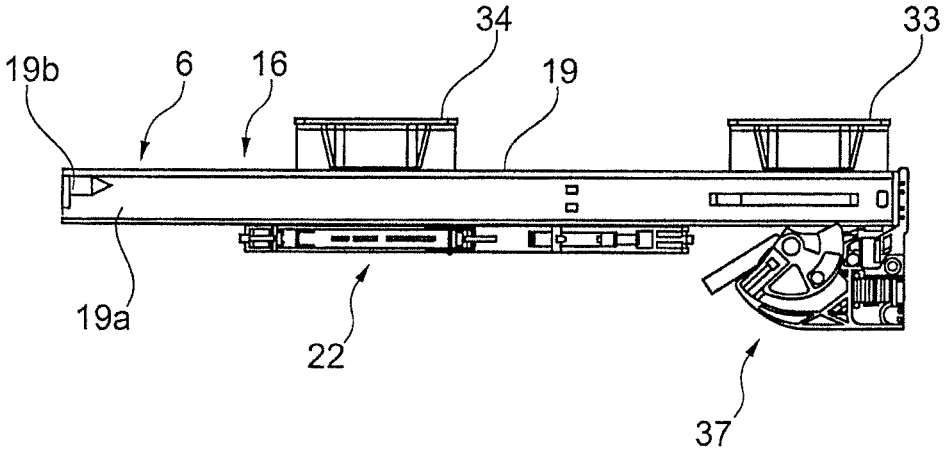
FIG. 6 shows a further guidance system structural unit not represented in FIG. 5 with a connecting device according to the present invention, seen from above.

The components of the connecting device 37 consist preferably of a plastic material. FIG. 6 shows only the fully contracted rail full extension 6 from above with coupled and interlocked connecting device 37 arranged functionally correct thereon. The drawer 3 is accordingly supported by a respective side part of the bottom side of the drawer bottom 14 on the two rail full extensions 6 and 7 or on the respective top side 19*a* of the push element rail 19.

A main piece 39 of the connecting device 37 is screwed at the bottom to the drawer 3 or to a bottom side of the drawer bottom 14 in the region of a front bottom corner area, for example, with screw fasteners, such as two screws 38, which reach through prepared openings in the main piece 39 and are screwed into the drawer bottom 14 underneath. A fastening of the main piece 39 to the front element 12 at the back side is likewise possible.

The connecting device 37 comprises, besides the main piece 39, a locking element 40, the main piece 39 and the locking element 40 being two separate components.

Figure 9:
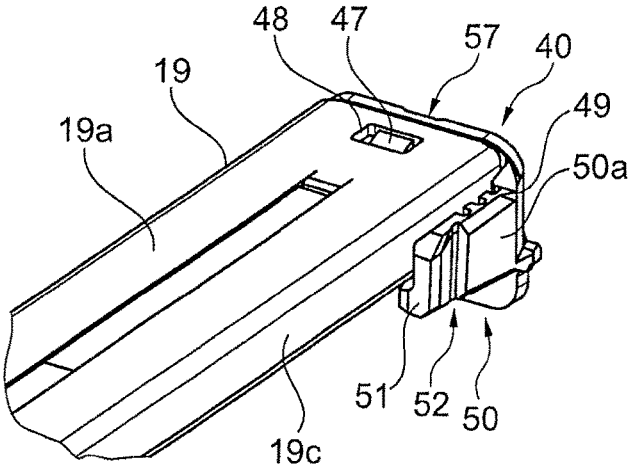
FIG. 9 shows a front end segment of the push element rail of the guidance system structural unit shown in FIG. 6, seen from above, there being mounted on the push element rail a locking element of the connecting device according to the present invention.
Figure 10:
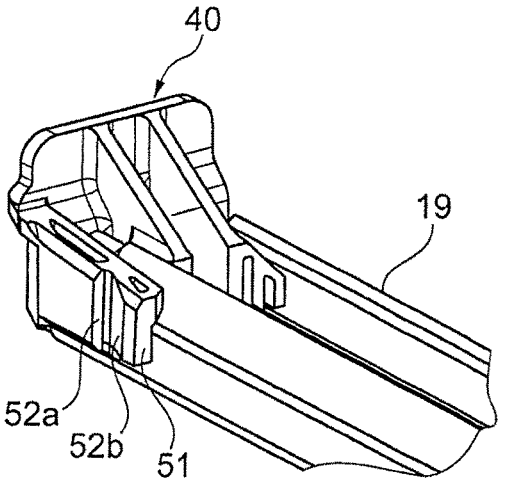
FIG. 10 shows the bottom side of the end segment represented in FIG. 9.

The main piece 39 serves for fastening to the push element or to the drawer 3 and the locking element 40 is fastened or firmly attached onto the push element rail 19 at its front end side (see FIGS. 9, 10).

The connecting device 37 comprises a locking arm 41, with a locking member 42, on the main piece 39, which locking arm can move relative to the remaining portions of the main piece 39. The locking member 42 is preferably configured as a locking tooth or with a tooth-shaped contour.

The locking arm 41 is divided into a front arm segment 41*a* and a rear arm segment 41*b*. The two arm segments 41*a*, 41*b* are each substantially straight and provided in a middle segment, relative to the length of the locking arm 41, with an angling 43, so that the two arm segments 41*a*, 41*b* are oriented at an angle to each other.

Figure 7:
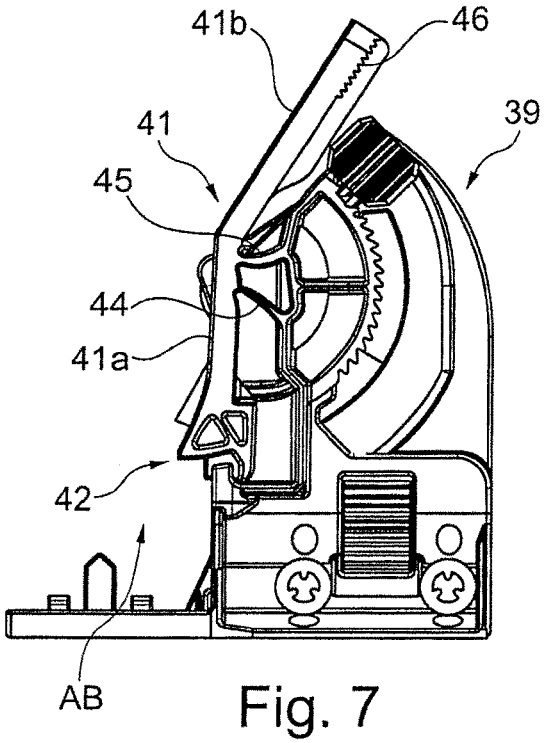
FIG. 7 shows a main piece of the connecting device according to the present invention at the push element side, in bottom view in a base position.
Figure 8:
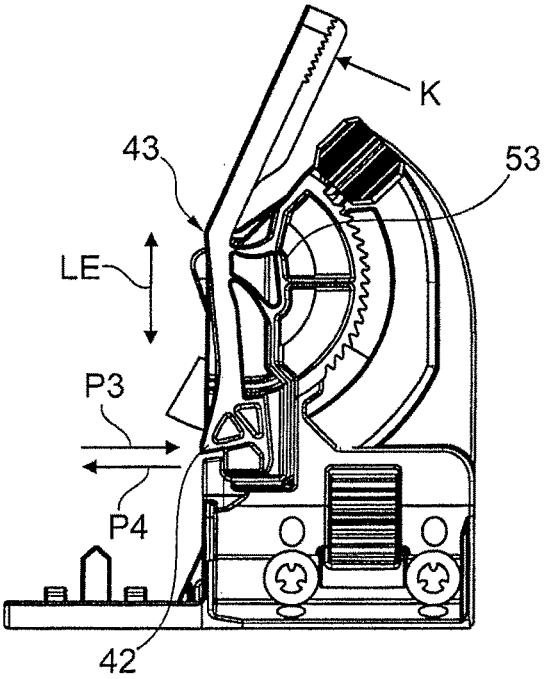
FIG. 8 shows the connecting device of FIG. 7 in a deflected position of a locking arm.

In the base position of the main piece 39 represented per FIG. 7, the front arm segment 41*a* is positioned such that the locking member 42 protrudes into a receiving area AB of the main piece 39, in which the front end of the respective push element rail 19 is present in the connected condition of the drawer 3 and the corresponding rail full extension.

The rear arm segment 41*b* extends away from the receiving area AB. The locking arm 41 is only attached to the remaining portion of the main piece 39 by two web or arm-shaped attachment members 44 and 45, the attachment members 44 and 45 being configured on the inner side of the front arm segment 41*a* near the angling 43.

The first attachment member 44 is situated closer to the locking member 42 than the second attachment member 45. Both attachment members 44 and 45 are elastically deformable, which makes possible an engaging and disengaging movement of the locking arm 41 on the locking element 40. A movement of the front end of the locking arm 41 or the front arm segment 41*a* with the locking member 42 occurs in the direction P3 and P4 or transversely to the longitudinal extension LE of the locking arm 41 and in the direction of the attachment member 44, 45.

For the desired kinematics, the first attachment member 44 has a corresponding configuration and dimensioning, with a lesser thickness at the end connected to the locking arm 41 and a greater thickness at an opposite end, which is connected to a rigid wall 53 of the main piece 39.

The orientation of the first attachment member 44 is slanting to the longitudinal extension LE of the locking arm 41. The point of the connection of the first attachment member 44 on the rigid wall 53 lies in the longitudinal extension LE closer to the locking member 42 than the point of the connection of the first attachment member 44 on the locking arm 42. The first attachment member 44 in the base condition of FIG. 7, i.e., with no force acting from the outside, is relatively slightly curved with a slightly concave side directed toward the locking member 42. The opposite side of the first attachment member 44 is correspondingly slightly convex curved.

The further second attachment member 45 present for the elastic deflection movement of the locking arm 41 is situated on the locking arm 41 somewhat further away from the end of the locking arm 41 having the locking member 42. The attachment member 45 has a somewhat greater thickness than the first attachment member 44. Furthermore, the attachment member 45 is convex curved on the side pointing in the direction of the locking member 42. The opposite side of the attachment member 45 is accordingly concave curved.

The deformation behavior of the two attachment members 44 and 45 is attuned to the connecting device 37 such that, for example, when a force K is acting from the outside on a control element 46 of the arm segment 41*b*, the locking arm 41 is moved such that the region of the locking arm 41 on which the locking member 42 is present performs an at least almost linear movement transversely to the longitudinal extension LE of the locking arm or in the direction P3. The movement of the locking member 42 in the direction P3 also occurs during the installation described further below. Upon partial slackening or absence of the force K acting from the outside on the control element 46 or the locking member 42, the locking arm 41 returns in corresponding manner. Accordingly, the front end region of the locking arm 41 on which the locking member is present returns in linear manner in the direction P4. This occurs due to the elastic pretensioning of the two attachment members 44, 45.

FIGS. 9 and 10 show the front end of the push element rail 19 from above (FIG. 9) and from below with the locking element 40, which preferably consists of plastic, being mounted on the metallic push element rail 19 and interlocked there. For the interlocking, the locking element 40 comprises, besides further locking segments, a slightly elastically deflectable locking lug 47, for example, which in the mounted condition engages and interlocks with a matching recess 48 in the web of the push element rail 19, forming the top side 19*a*. The locking element 40 is thus secured at the front end on the end face of the push element rail 19.

In the mounted condition of the locking element 40, it encloses the front end of the push element rail 19 and, by an angling 50 of the locking element 40, a front end segment of a side wall 19*c* of the push element rail 19. The angling 50 has a stopping surface 51 oriented at right angles to the side wall 19*c* and protruding beyond it. Furthermore, the angling 50 has a side notch 52 on an outer side, which outer side in the attached condition is offset in parallel with the side wall 19*c*, which notch is designed for a matching engagement with the locking member 42.

The connecting and releasing of a push element or the drawer 3 to or from a guide rail or the push element rail 19, FIG. 5 showing the finished connection condition on one side of the drawer bottom 14, is further explained with the aid of FIGS. 11 to 14, in which the drawer 3 with the drawer bottom 14 is not shown.

Figure 11:
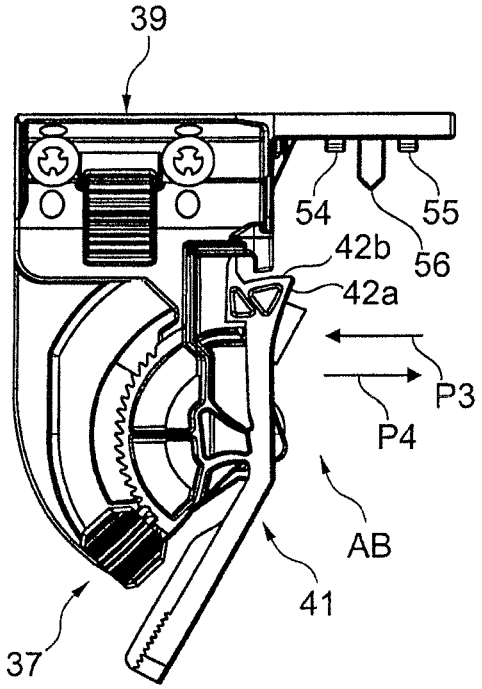
FIG. 11 shows the main piece of the connecting device in a view rotated by 180 angular degrees relative to the representation in FIG. 7.
Figure 12:
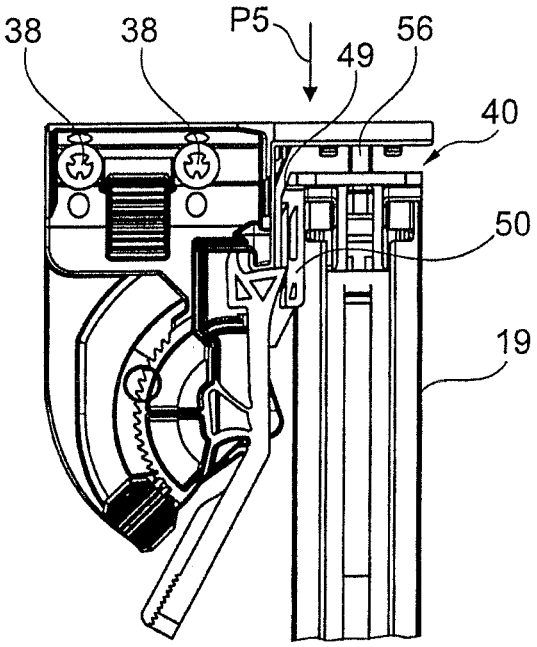
FIG. 12 shows the main piece of FIG. 11 and an end segment of the push element rail of FIGS. 9, 10 in a prelatching position.
Figure 13:
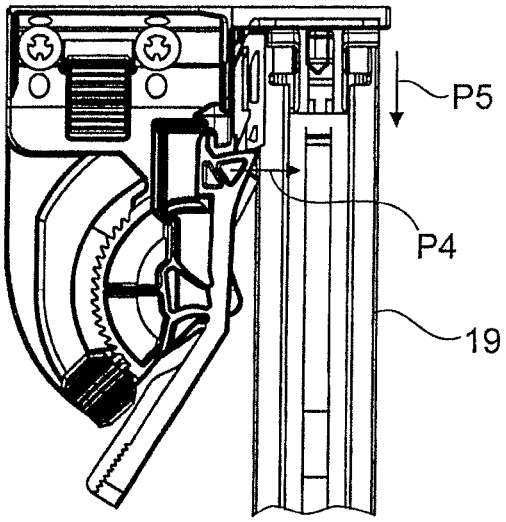
FIG. 13 shows the arrangement of FIG. 11 in a locking position.
Figure 14:
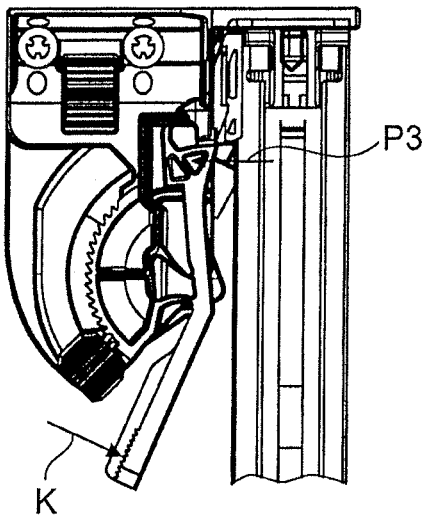
FIG. 14 shows the arrangement of FIG. 13 in a disengaged position of the arrangement or the locking arm.

FIG. 11 shows the base position of the connecting device 37, in which the locking member 42 protrudes by locking edges 42*a*, 42*b* somewhat into the receiving region AB.

After placing the rear portion of the drawer 3 or the drawer bottom 14 on the two push element rails 19 of the rail full extensions 6, 7, sticking out from the furniture body 2 and projecting to the front, the drawer 3 is pushed in the direction P2 or P5 and lowered in front until the two connecting devices 37 come close to the front end of the push element rails 19. In the following, the interplay on one side at the bottom side of the drawer bottom 14 shall be explained. A corresponding interplay occurs at the same time on the other side.

Upon pushing the drawer 3 in the direction P5, a slanting approach surface 49 on the locking element 40 comes into matching surface contact with the slanting latching face 42*a* on the locking member 42. The locking arm 41 here is somewhat deflected under elastic deformation of the attachment members 44, 45 in the direction P3, so that upon further pushing in the direction P5 the deflected locking member 42 slides along one side surface 50*a* of the angling 50 until the locking member 42 engages with spring action in the notch 52, due to the pretensioned attachment members 44, 45. A prelatching position is reached per FIG. 12. With this, a prepositioning of the drawer 3 on the furniture body 2 is established on both sides on the full extensions. The interlocking so established for the locking member 42 prevents the drawer 3 being removed from the push element rail 19 by pulling it out in the direction opposite P5, because the latching face 42*b* is blocked on a surface 52*a* transversely to the longitudinal extension (see FIG. 10) of the notch 52.

If the drawer 3 is now pushed by a few millimeters further in the direction P5, the locking arm 41 is further deflected in the direction P3, since a further surface 52*b* of the notch 52 slanted toward the longitudinal extension presses against the latching face 42*a*.

At the end of the surface 52*b*, the pretensioned locking arm 41 with the locking member 42 gets free of the notch 52 and the pretensioned locking arm 41 engages in the direction P4 (see FIG. 13) by its latching face 42*b* with the stopping surface 51. The connecting device 37 is interlocked on the push element rail 19. Present on the locking element 40 are spring means 54, 55 as two spring arms projecting inward to the receiving area AB, and a rigid pin element 56, which engages in a matching opening 57 at the end face in the locking element 40 with some play. In the interlocked condition per FIG. 13, the spring means 54, 55 press against the locking element 40, so that a length equalizing is provided. The stopping surface 51 lies pressing against the latching face 42*b*.

To release the interlocking, a person presses on the control element 46 with a force K, whereby the locking arm 41 in the region of the locking member 42 is deflected in a linear manner or by pushing in the direction P3 and the interlocking is released. The drawer 3 is free from the locking element 40 when both connecting devices 37 are actuated at the same time per FIG. 14 and it can be lifted forward and off from the push element rail 19.

LIST OF REFERENCE NUMBERS

1 Piece of furniture
2 Furniture body
3 Drawer
4 Side wall
5 Side wall
5*a* Inner side
6 Rail full extension
7 Rail full extension
8 Rail full extension
9 Rail full extension
10 Drawer side wall
11 Drawer side wall
12 Front element
12 Rear wall
13 Drawer bottom
14 Hollow chamber frame
15*a* Housing
15*b* Internal structure
16 Full extension
17 Body rail
18 Center rail
19 Push element rail
19*a* Top side
19*b* Hook element
19*c* Side wall
20 Carriage
20*a* Segment
20*b* Segment
21 Carriage
21*a* Segment
21*b* Segment
22 Movement mechanism
23 Horizontal wall section
24 Horizontal wall section
25 Side wall section
26 Side wall section
27 Side wall section
28 Side wall section
29 Weld seam
30 Pushing direction
31 Rail body
32 Pin
33 Fastening element
34 Fastening element
35 End stop
36 End stop
37 Connecting device
38 Screw
39 Main piece
40 Locking element
41 Locking arm
41*a* Arm segment
41*b* Arm segment
42 Locking member
42*a* Latching face
42*b* Latching face
43 Angling
44 Attachment member
45 Attachment member
46 Control element
47 Locking lug
48 Recess
49 Approach surface
50 Angling
50*a* Side surface
51 Stopping surface
52 Notch
52*a* Surface
52*b* Surface
53 Wall
54 Spring means
55 Spring means

56 Pin element
57 Opening

The invention claimed is:

1. A device for connecting a movable push element of a piece of furniture or a household appliance to a guide rail of a guidance system for the piece of furniture or the household appliance, the device being adapted to be mounted on the movable push element, wherein the device comprises:

a locking arm with a locking member adapted to be coupled with a corresponding locking part, wherein the locking arm is an elongated element, wherein the locking arm is connected by precisely two spaced-apart, curved attachment members to a remainder of the device, wherein the two spaced apart, curved attachment members engage with the locking arm transversely with respect to a longitudinal extension of the locking arm, wherein the two spaced apart, curved attachment members each have a curved shape, extending along a respective length of each of the two spaced apart, curved attachment members whereby the two curved attachment members each extend from respective first ends thereof proximate the remainder of the device along a curved shape toward respective second ends thereof proximate the locking arm, and wherein the curved shapes of the two spaced apart, curved attachment members are curved in opposite directions from one another, and wherein the two space apart, curved attachment members are elastic so that the locking arm is movable in a region of the locking member in a direction transverse with respect to the longitudinal extension of the locking arm and in a direction of the two attachment members.

2. The device according to claim 1, wherein the locking arm comprises a control element, which is angled relative to a remaining elongated portion of the locking arm, so that the locking arm is movable by the control element.

3. The device according to claim 1, wherein during a positioning of the locking arm, the locking arm performs a movement transversely with respect to the longitudinal extension of the locking arm and/or along the longitudinal extension of the locking arm, and wherein during the positioning, a movement path transverse with respect to the longitudinal extension of the locking arm is comparatively larger than a movement path lengthwise with respect to the longitudinal extension of the locking arm.

4. The device according to claim 1, wherein the locking member is a single locking tooth.

5. The device according to claim 1, wherein the two space apart, curved attachment members are substantially cuboidal wall elements.

6. The device according to claim 1, wherein a thickness of at least one of the two space apart, curved attachment members decreases from a first end thereof proximate the remainder of the device toward a second end thereof proximate the locking arm.

7. The device according to claim 1, wherein a thickness of a first one of the two space apart, curved attachment members is larger than a thickness of a second one of the two space apart, curved attachment members.

8. The device according to claim 1, further comprising a device locking element, which is present as a single structural part separate from the remainder of the device, wherein the device locking element comprises a mounting element, the mounting element adapted to mount the device locking element on an end face of a guide rail, and wherein the device locking element is adapted to interlock with the locking member of the device in a mounted condition of the device.

9. The device according to claim 1, further comprising a spring that pretensions the coupling of the locking member to the locking part in a direction along the longitudinal extension of the locking arm.

10. A guidance system comprising the device according to claim 1.

11. A piece of furniture or a household appliance including the guidance system according to claim 10.

12. The device according to claim 3, wherein the locking arm performs a movement parallel to the longitudinal extension of the locking arm during the positioning of the locking arm.

* * * * *